United States Patent [19]

Sutter et al.

[11] Patent Number: 4,838,554

[45] Date of Patent: Jun. 13, 1989

[54] TOYS

[76] Inventors: James J. Sutter, 833 Blue Falls Pl., Reno, Nev. 89511; Marvin Roberts, 2305 S. Arlington Ave., Reno, Nev. 89509

[21] Appl. No.: 43,671

[22] Filed: Apr. 28, 1987

Related U.S. Application Data

[63] Continuation-in-part of Ser. No. 908,496, Sep. 17, 1986, abandoned.

[51] Int. Cl.[4] ..... A63F 5/04

[52] U.S. Cl. ..... 273/143 R; 446/9

[58] Field of Search ..... 273/143 R, 143 A, 143 B, 273/143 C, 143 D, 143 E; 446/8, 9

[56] References Cited

U.S. PATENT DOCUMENTS

| | | | |
|---|---|---|---|
| 2,121,494 | 6/1938 | Babcock . | |
| 2,180,029 | 11/1939 | Babcock . | |
| 3,011,790 | 12/1961 | Brunson . | |
| 3,464,693 | 9/1969 | Bailey | 273/143 R X |
| 3,565,441 | 2/1971 | Matsumoto . | |
| 3,747,936 | 7/1973 | Ohki | 446/9 X |
| 4,002,335 | 1/1977 | Bailey . | |
| 4,097,048 | 6/1978 | Poulsen et al. | 273/143 R |
| 4,239,224 | 12/1980 | Stanley | 273/143 R |
| 4,249,737 | 2/1981 | Hanclerick | 273/143 R |
| 4,261,571 | 4/1981 | Ito | 273/143 R |
| 4,273,333 | 6/1981 | Nicolaus . | |
| 4,505,167 | 3/1985 | Nicolaus | 273/143 R X |
| 4,773,648 | 9/1988 | Itol | 273/143 R |

FOREIGN PATENT DOCUMENTS

| | | | |
|---|---|---|---|
| 0324941 | 10/1928 | United Kingdom . | |
| 1104958 | 3/1968 | United Kingdom . | |
| 1250602 | 10/1971 | United Kingdom . | |
| 1305997 | 2/1973 | United Kingdom . | |
| 2076204 | 11/1981 | United Kingdom | 273/143 R |

*Primary Examiner*—Carlton R. Croyle
*Assistant Examiner*—Eugene L. Szczecina, Jr.
*Attorney, Agent, or Firm*—Townsend and Townsend

[57] ABSTRACT

A toy money box resembling a slot machine has one money slot where the money enters a store and is returned if the slot machine when operated gives a jackpot. The money box has a second slot where money passes to a store separate from the slot machine and acts as a conventional money box. A mechanism for controlling the slot machine is provided which is simpler than previous mechanisms. In one aspect, the chance wheels are rotated by a gear drive which rotates one chance wheel through a one-way clutch and similar one-way clutches between adjacent pairs of chance wheels impart the rotation sequentially to all of the wheels. A clutch mechanism between the operating handle and the gear drive can comprise a pawl rotatably engaged within a cylindrical sleeve, the end of the pawl engaging a opening in the sleeve for transmitting rotary motion from the pawl to the sleeve and a cam being provided to disengage the end of the pawl when a particular extent of rotation has been reached. Also, single means are provided both to stop the chance wheels at an arbitrary position and to detect a winning orientation and so release money as a jackpot. To delay the stopping of the wheels, the sensor may be linked to a damper mechanism.

15 Claims, 9 Drawing Sheets

FIG. 11.
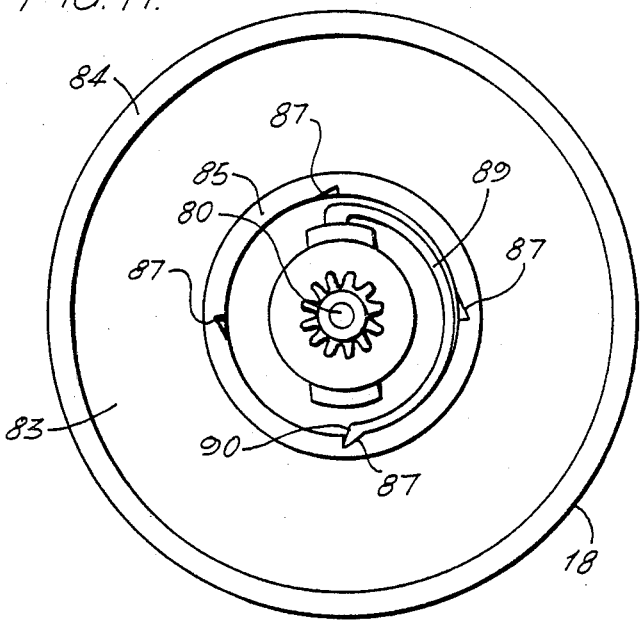
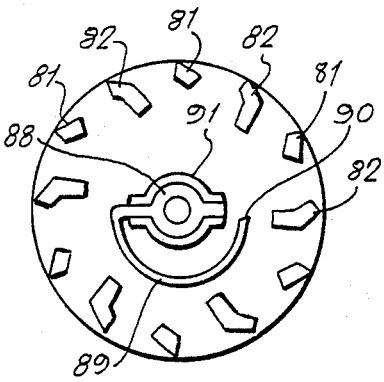
FIG. 12.
FIG. 13.
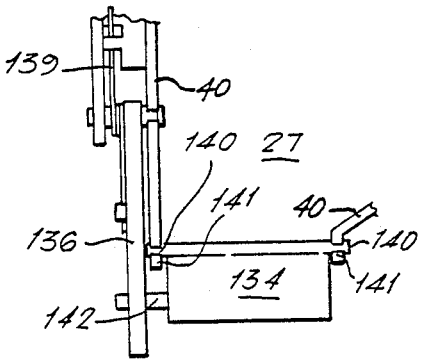

TOYS

REFERENCE TO RELATED APPLICATION

This Application is a Continuation-in-part of our co-pending application Ser. No. 06/908,496 filed 17th Sept. 1986, now abandoned.

BACKGROUND TO THE INVENTION

This invention relates to toys and in particular a toy which resembles a slot machine or one-armed bandit as they are sometimes called and which can additionally act as a toy money box if desired.

Toy money boxes come in various forms from the simplest piggy bank which is a housing in some pleasing shape with a slot at the top in which to insert coins and a temporary opening closed by a cap or like at the bottom or the back through which the money save can be recovered when required.

An object of the present invention is to provide a toy money box which resembles a slot machine and so provides an added degree of interest.

The full size slot machines are highly complex pieces of machinery and so the toy according to the invention needs to be relatively simple in its construction and operation.

There have been a number of proposals in the past to make toy money boxes in th form of slot machines and examples are U.S. Pat Nos. 4,261,571 and 4,504,058. Both of these Patents however show mechanisms which are complex, are difficult to assemble and therefore overall are expensive.

It is therefore an onject of the present invention to provide an altogether simpler type of toy money box in the form of a mechanical slot machine.

BRIEF SUMMARY OF THE INVENTION

According to the invention in one aspect, there is provided a toy money box comprising an outer casing, a first coin inlet formed in said casing, a money store within said casing into which coins pass when inserted into said first coin inlet, a base to said money store movable to a normally closed position to retain coins in said store and an open jackpot position to release coins from said store, a number of rotatable chance wheels mounted in said casing and arranged to be spun and stopped at random orientations, indicia carried by said wheels, only certain of said indicia being winning indicia when a respective wheel stops with one of certain indicia in a winning orientation whereby when said wheels stop in a winning orientation the resulting array of indicia corresponds to movement of said base to said jackpot position, sensor means pivotably mounted in said casing for engaging said wheels to detect winning orientation of winning indicia and being capable of moving said base to said jackpot position when said winning orientation is detected, and drive means for rotating said chance wheels, said drive means including a manually operated handle hingedly mounted to and exterior of said casing, gear means driven by said handle and engaging a first one-way clutch mechanism for rotating a first chance wheel, a second one-way clutch mechanism between said first and a second chance wheel for rotating said second chance wheel when said first chance wheel is rotated by said gear means, and additional one-way clutch mechanisms between subsequent adjacent pairs of chance wheels for sequentially driving subsequent chance wheels from a preceding chance wheel when said preceding chance wheel is driven into rotation.

Additionally according to another aspect of the invention, there is provided a machine comprising an outer casing, a plurality of rotatable chance wheels mounted in said casing and arranged to be spun and stopped at random orientations, indicia carried by said wheels, and drive means engaging a first one-way clutch mechanism for rotating a first of said wheels, a second one-way clutch mechanism between the first of said wheels and a second of said wheels for rotating said second wheel by rotation of the first of said wheels, and additional one-way clutch mechanisms between subsequent adjacent pairs of said wheels for rotating subsequent said wheels sequentially by the rotation of each preceding said wheel when said preceding wheel is driven into rotation.

Such an arrangement including the gear train and the one-way clutch mechanisms sequentially driving the chance wheels provides a simple mechanism for imparting rotation to all chance wheels. Such a mechanism is substantially simpler than previously used mechanisms where a separate kick has been imparted to each chance wheel which is itself freely and rotatably mounted relative each other chance wheel. Such an arrangement according to the invention is simple to assemble and relatively cheap to manufacture.

When the external handle is pulled forward to its limit position, a clutch mechanism is provided to disengage the drive between the handle and the gear means. The gear train is then driven by the energy stored in resilient means to which energy is imparted as the handle is hinged forward. Conveniently, these resilient means are in the form of a simple coil spring.

According to yet another aspect of the invention, this clutch mechanism comprises an outer cylindrical housing provided with an opening in the cylindrical wall, and enclosed within that cylindrical housing is a driven pawl mechanism including a resilient arm having an end capable of engaging in said opening, the arrangement being such that when said end of said arm is engaged in said opening rotation of said pawl in one direction by said handle causes said end to engage said opening and drive said outer housing, said outer end further comprising a projecting portion engageable by cam means on a non-rotatable member relative said pawl member, said cam means on said non-rotatable member caming said end inwardly out of engagement with said opening at one limit position whereby once said end is camed out of engagement with said opening, the outer housing and pawl are free to rotate relative one another.

Such a clutch mechanism can be extremely simple both to construct and to assemble and in addition is highly effective in operation.

In one preferred embodiment according to the invention, the driven pawl is directly connected to the hinged handle and so driven by it whilst the outer housing can be provided with suitable gear teeth to engage the gear drive to drive the chance wheels.

In the prior Patents discussed above, the separate arrangements for stopping the chance wheels at some random orientation and for sensing the alignment of a winning arrangement have been separate mechanisms. According to another aspect of the present invention, however, these two functions can be combined into a single arrangement and so simplify the operation and construction of the toy money box.

According to this aspect of the invention therefore, there is provided a machine comprising an outer casing, a plurality of rotatable chance wheels mounted in said casing and arranged to be spun and stopped at random orientations, indicia carried by said wheels, stopping elements formed on said wheels, some of said stopping elements having different constructions and certain of said indicia corresponding to a difference in construction of a stopping element on said wheels, sensor means pivotably mounted in said casing, a plurality of arcuately shaped fingers fixedly attached to said sensor means, each of said fingers corresponding to one of said wheels, said fingers engaging said wheels to sequentially stop said wheels and to sense said difference in construction of said stopping elements corresponding to the orientation of said indicia on the stopped said wheels.

Thus, in this aspect of the invention, a sensor member is provided which is pivotably mounted in the casing and resiliently urged from a retracted position to an advanced position, the member being connected to the handle so as to be moved to its retracted position as the handle is operated and said chance wheels are driven into rotation, and the member comprising integral fingers, one associated with each chance wheel, and said chance wheels further comprising stop means to be contactable by said fingers, whereby when said fingers initially engage said stop means the respective chance wheel is stopped, and said stop means further being of two types, one corresponding to a winning orientation on a chance wheel and the other corresponding to a non-winning orientation which has a stop to prevent said sensor advancing beyond its advanced position, whereby the arrangement of the fingers and the stop means is such that when all fingers engage with a stop means of a winning type, said fingers and so said sensor member is able to advance further beyond said advanced position, and said sensor member further comprising an integral arm for moving said base to said money store to said jackpot position when said sensor member is able to advance beyond its said advanced position to its payout position.

Such an arrangement provides a substantial simplification in a number of parts necessary and therefore simplifies construction and operation of the device.

According to a preferred embodiment of the invention, the fingers of the sensor travel in an arcuate path which is offset from a path that would intersect the axis of rotation of its corresponding chance wheel.

In order to allow the chance wheels to rotate for a certain length of time once they have been driven into rotation and the sensor member retracted, a timer mechanism is provided to delay the movement of the sensor member into engagement with the stop means on the chance wheels. Preferably, however, this timer mechanism only delays the movement of the sensor member from its retracted position to its advanced position and does not affect the movement of the sensor member beyond its advanced position.

BRIEF DESCRIPTION OF THE DRAWINGS

An example of a toy money box in the form of a simulated slot machine according to the invention will now be described, with reference to the accompanying drawings, in which:

FIG. 11 is an enlarged detail view taken in the direction of the arrow 11 of FIG. 3;

FIG. 12 is a detail view taken in the direction of the arrow 12 of FIG. 3; and FIG. 13 is an enlarged detail view of the front of the operating mechanism.

DESCRIPTION OF THE PREFERRED EMBODIMENT

Figure 1:
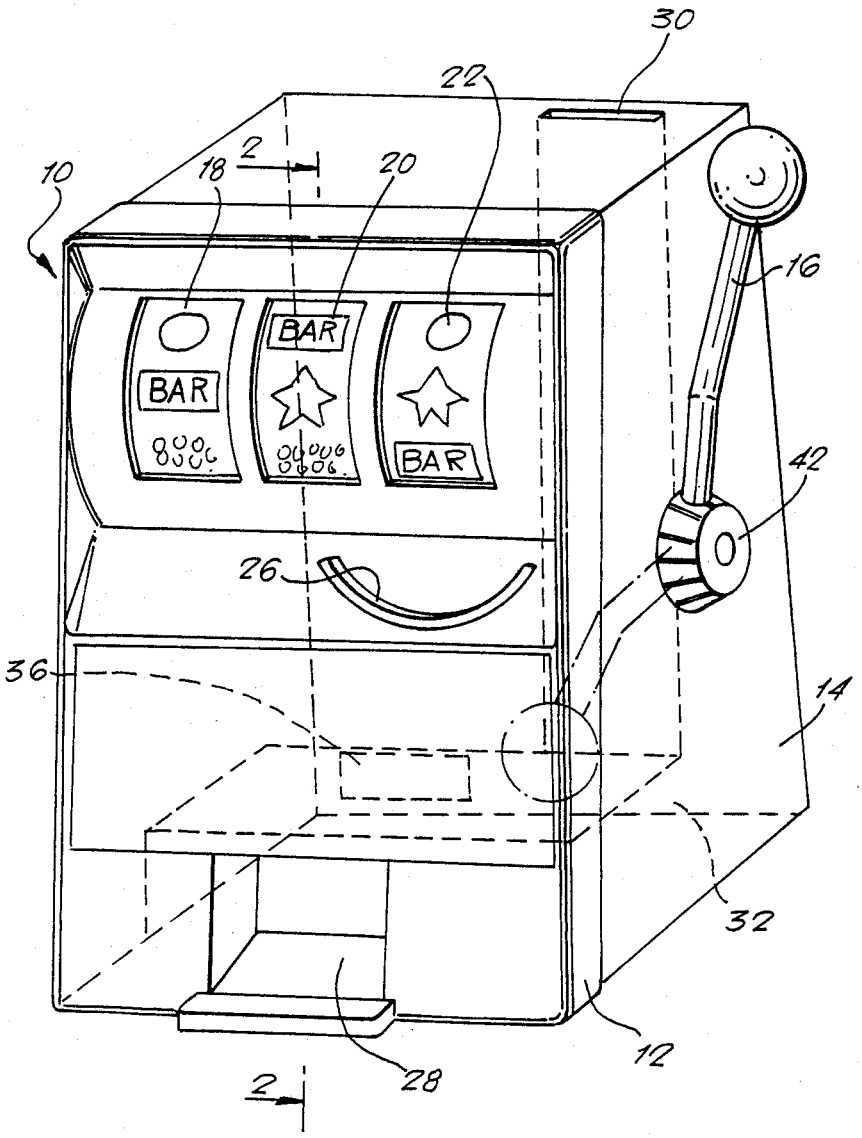
FIG. 1 is a front perspective view of the toy with certain internal parts shown in broken lines.

The toy money box 10 in the form of a slot machine is shown generally in FIG. 1 of the drawings. It comprises a front casing 12 and a rear cabinet 14. On the side of the cabinet is hingedly mounted an operating handle 16 and visible through the front casing are parts of three chance wheels 18, 20 and 22 which are rotated when the handle 16 is hinged. There may be more than or less than three chance wheels.

The top 10 has a first money slot 26 in the front casing and this will be described later. Money inserted through that slot is held in a store 27 through which it will be released to a money outlet 28 in the front casing 12 in the event that the chance wheels stop in a winning alignment. However, all the time that the chance wheels stop in anything but in a winning alignment, the money will be retained.

Figure 2:
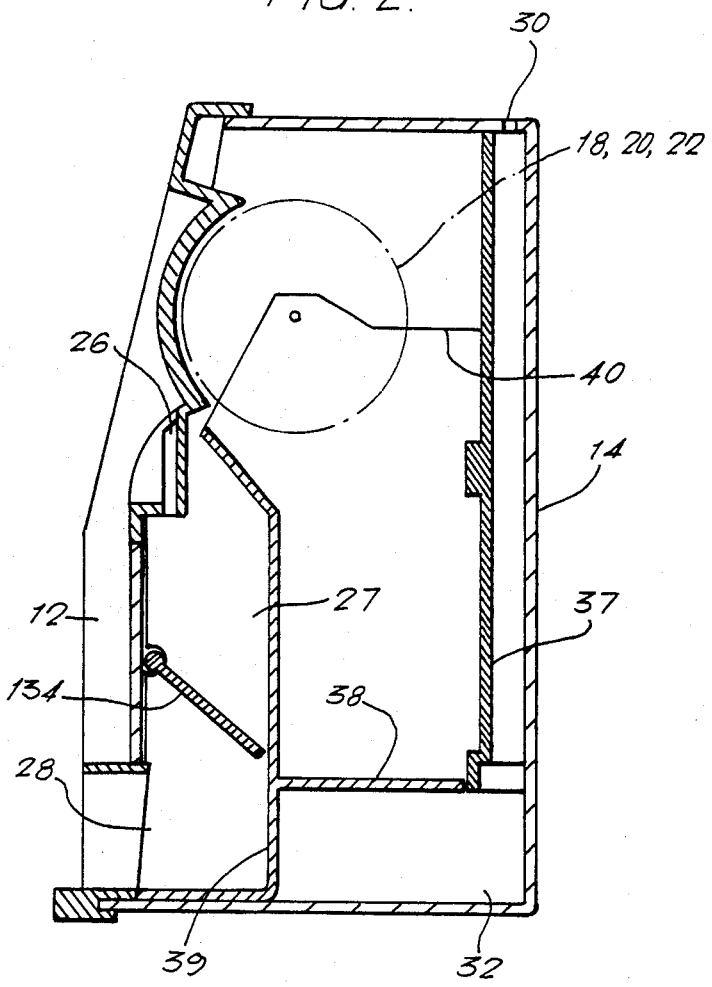
FIG. 2 is an upright cross section approximately on the line of 2—2 of FIG. 1 but omitting details of the operating mechanism.
Figure 3:
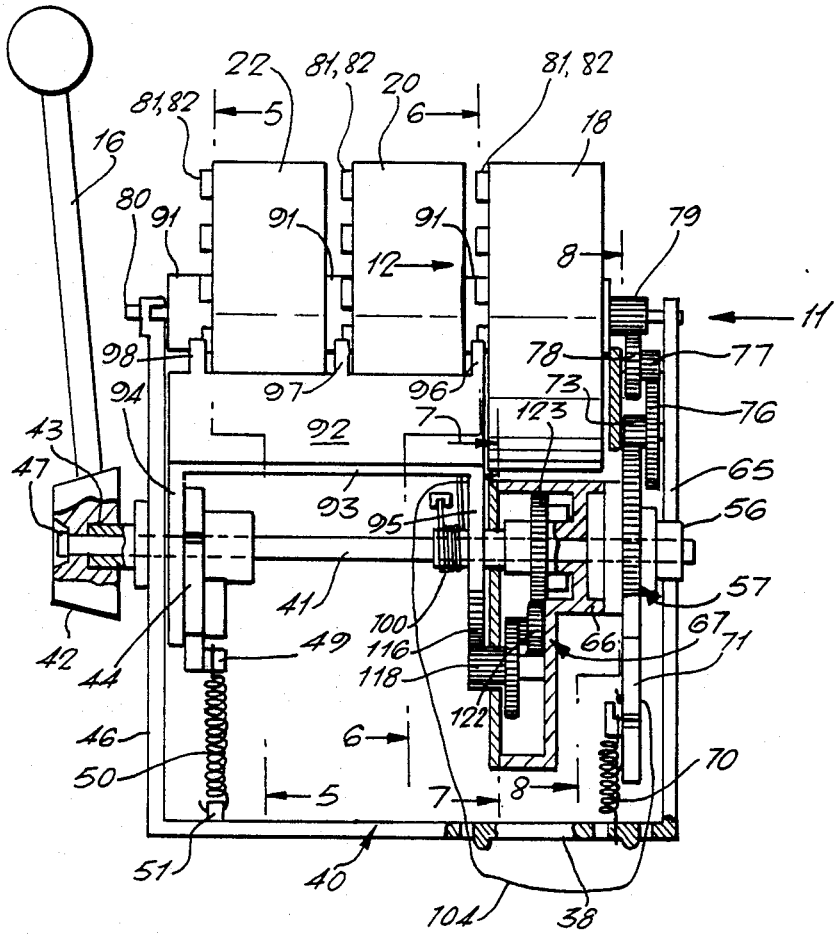
FIG. 3 is a rear elevational detail showing the mechanism within the toy.
Figure 4:
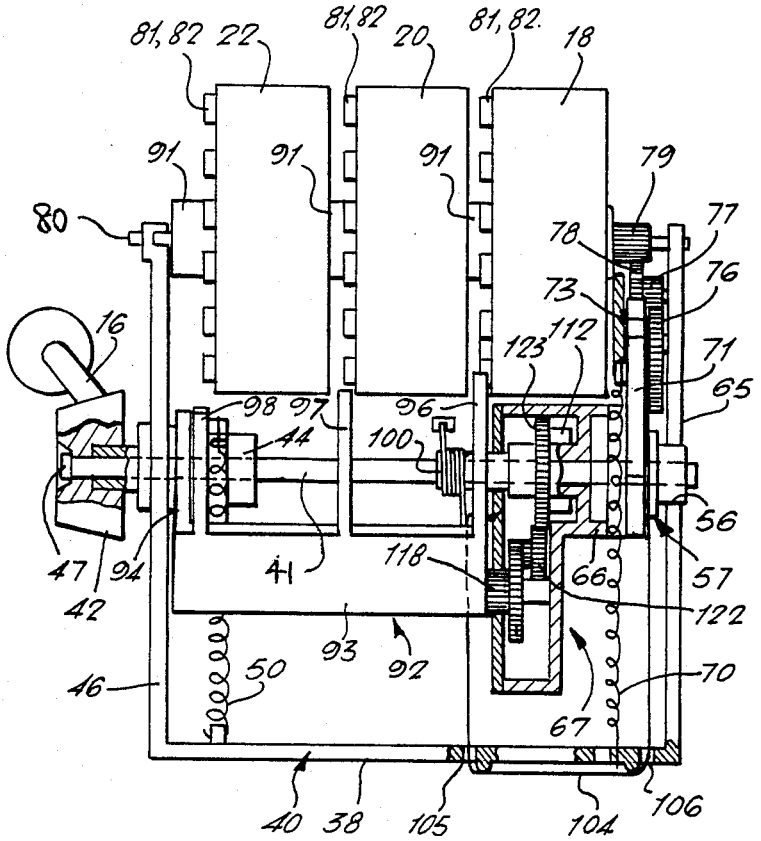
FIG. 4 is a view similar to FIG. 3 but showing the mechanism in a stage of operation.

In the top of the cabinet 14 is provided a second slot 30 and as best shown in FIGS. 1 and 2, that slot leads to a money compartment 32 at the base of the casing. This is defined by the rear, side and bottom walls of the rear of the cabinet and at its top and front by walls 38 and 39 forming part of a chassis 40 mounted within the cabinet and on which the operating mechanism is supported.

Money placed through the slot 30 is not in any way controlled by the chance wheels but instead is retained in the compartment 32. As shown in FIG. 1, the rear of the cabinet has a removable door 36 near its base and when money is to be removed from the compartment, the door 36 is opened to remove that money. In this way the money box 10 can function as a conventional money box with money being held until the user wishes to remove it.

In order to guide the money from the slot 30 to the compartment 32, and elongated cover 37 is positioned adjacent the rear wall of the cabinet (see FIG. 2).

The handle 16 is attached to a square shaped drive shaft 41 rotatably journalled in the chassis 40. At its inner end the handle has a central spigot 42 which has a hollow square-shaped central opening 43 which engages over a square-shaped spigot of crank 44. The crank has a circular shaft which engages in a corresponding hole in the side wall 46 of the chassis 40 and is journalled thereby to support one end of the shaft 41. The square-shaped spigot extends outwardly from the circular shaft and the spigot 42 of the handle engages it and is held in place by means of a screw 47.

Figure 5:
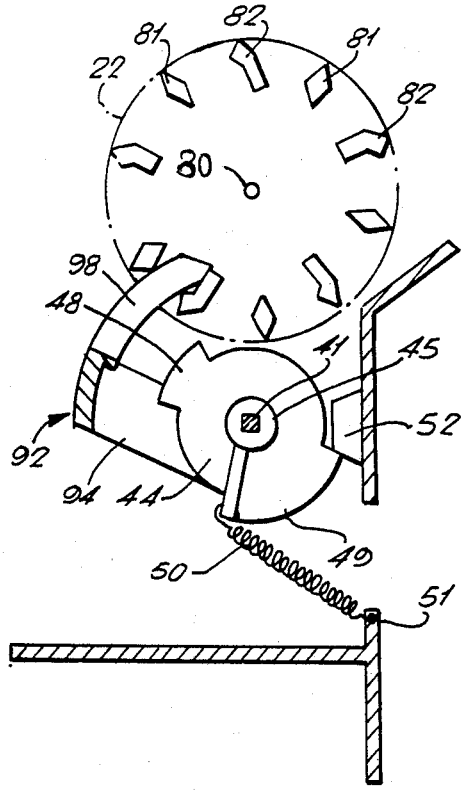
FIG. 5 is a detail section taken on the line 5—5 of FIG. 3.

The crank 44 also includes a pair of sector-shaped arms 48 and 49. Extending from the arms 49 is a tension spring 50 whose other end is attached at the point 51 to the chassis 40. The arm 49 also contacts a stop 52 on the chassis when the handle 16 is in its rest position as best shown in FIG. 5. The other arm 48 of the crank abuts the stop 52 to act as a limit on the extent of movement of the handle to its forward actuating position. Thus, the handle can move forward to the position shown in dotted lines in FIG. 1 but no further. The spring 50 becomes tensioned however as the handle 16 is pulled forward and so when it is released, the spring will cause the crank and the associated handle to return to the upright initial position shown in FIG. 1.

At the other end of the drive shaft 41 is mounted a pawl 54. This is keyed to the shaft so as to be rotatable with it and the pawl has an outer circular sleeve portion 55. This is engaged in a correspondingly shaped sleeve 56 forming part of a crank or outer cylindrical housing 57 to be described so as to journal that pawl. The pawl 54 also includes an integrally formed resilient spiral-shaped arm 58 having an outer enlarged end 59.

Surrounding the pawl 54 and its resilient arm 58 is the one-armed crank 57. This crank includes a hollow circular recess 60 within which the pawl is positioned. The wall of the recess 60 is cut away to provide an opening 62 into which the enlarged end 59 of the pawl can engage. Thus, when the pawl 54 is rotated in the direction of the arrow 63, the end 59 will engage in the opening 62 and drive the crank 57 into rotation. However, when the pawl is rotated relative the outer housing in the opposite direction, an inclined cam surface 64 on the enlarged end 59 will cam the end of the pawl radially inward and the end will leave the opening 62 and so the pawl will simply slide relative the outer housing and crank 57 and not to drive it.

The crank 57 has the sleeve 56 and this is journalled in a side wall 65 of the chassis to support the other end of the shaft 41.

Mounted alongside the recess 60 is a stationary housing 66 containing a damper mechanism 67 whose operation will be described later.

The housing 66 has on its side adjacent the recess 60 a cam surface 68. The enlarged end of the pawl also has a sideways extending projection 69 which engages with the stationary cam surface 68 when the handle and pawl have reached a fully advanced position. This engagement has the effect of urging the end 59 of the pawl 54 out of engagement with the opening 62 and therefore releases the crank 57 from the drive shaft 41.

The crank 57 is therefore free to move under the effect of a tension spring 70 extending between the arm 71 of the crank and the wall 38 of the chassis 40. Therefore the tension spring will urge the crank arm 71 and crank 57 to rotate back to its initial position.

Meanwhile, when the handle 16 is released, it is drawn back to its original upright position by the spring 50 and so the pawl 54 is restored to its position and once the pawl and crank reach their initial positions, then the enlarged end 59 will again engage in the opening 62 so rotatably joining the pawl 54 and crank 57. In this position, the cam surface 68 will not engage the projection 69 on the side of the end of the pawl.

The outer surface of the crank 57 has a sector-shaped gear 72 integrally formed in it. This engages with a small first pinion 73 of a gear train 74 leading to the chance wheels 18 to 22. The gear train 74 consists of a first combined pair of which the small pinion 73 forms part and a larger gear 76 forms an integral part. This larger gear in turn engages with a small pinion 77 of a second integral gear pair and again the larger gear 78 of the pair engages with a pinion 79 mounted on a shaft 80 for the chance wheel 18 to 22.

As the handle 16 is brought from its upright to its forward position, the crank 57 is initially rotated and this causes the gear train to be rotated by engagement of the sector-shaped gear 72 on the crank 57 with the gear train. However, once the pawl 54 suddenly becomes released from the crank 57 as described above, the tension which is built up in the spring 70 causes the crank 57 to rotate back to its initial position and the tension in the spring drives the pinion 79 through the gear train 74. The gear train acts in a stepping-up sense, i.e. and approximately 90° extent of rotation of the crank causes a relatively high speed rate of rotation to be imparted to the pinion 79.

In this way a kick is given to the chance wheels 18 to 22 so that they are suddenly spun as is conventional with gaming machines of this general type.

Each of the chance wheels is freely and rotatably mounted on the shaft 80. In addition, each chance wheel includes on the left hand side as looked at from the rear of the toy a number of projecting integral teeth 81 and 82 whose functions will be described in due course. Further, each wheel is of hollow drum-shape and comprises a radial flange 83 on which the teeth 81 and 82 are integrally formed and an outer cylinder 84 integrally formed with the flange. On the outer cylinder 84 are marked suitable indicia as is conventional with gaming machines of this type and each tooth 81 or 82 corresponds to one of these indicia.

Further, extending axially and within the outer cylinder 84 is an intermediate clutch drum 85 also integrally formed with the flange 83 and a central bush 86 through which the shaft 80 passes on and by means of which the wheel is rotatably mounted.

The clutch drum 85 has on its radially interior facing surface a number of detents 87. Housed within this drum is a clutch 88 which includes a resilient spirally extending arm 89. The outer end 90 of the arm is slightly outwardly turned and is capable of engaging in one of the detents 87 in the event that the clutch is rotated in the sense of the arrow **90*a* relative the associated drum but, in the alternative, when the clutch is rotated in the opposite sense relative the drum, the arm will then merely slide freely with the drum 85**.

As seen from the rear, for the right-hand most chance wheel 18 which is adjacent the gear train, the final gear 79 has an integrally formed bush in which a clutch 88 is received. Therefore, when that gear 79 is rotated in the reverse sense as the handle is pulled forward, the arm of that clutch will simply slide freely round within the intermediate drum 85 of the wheel 18 and will not impart any rotation to that drum. However, when the pawl 54 becomes released, the crank 57 is urged quickly by the spring 70 to rotate the gear 79 in the opposite sense. This in turn drives the clutch 88 so that the end 90 of the arm now engages one of the detents 87 and causes the wheel 18 to rotate with the gear. Therefore that chance wheel 18 is driven into high speed rotation.

In a similar fashion, that chance wheel 18 has on its left side as seen from the rear an integral bush 91 in which is engaged a clutch member 88. In turn the arm 89 of that clutch will be capable of engaging with the intermediate clutch drum 85 of the middle chance wheels 20. Therefore, as the first chance wheel 18 is driven into rotation, the clutch 88 between it and the wheel 20 will in turn engage the middle wheel 20 and drive it into rotation. In an entirely analogous fashion, a clutch 88 exists between the middle chance wheel 20 and the left-hand chance wheel 22 and drives that chance wheel 22 into rotation when the previous two wheels 18 and 20 are rotated.

When the gear train 74 ceases to drive the chance wheels 18 to 22 because the crank 57 has returned to its initial position, then the three chance wheels can continue to free-wheel and the clutch 88 between the gear 79 and the chance wheel 18 will simply slip within the drum 85.

Rotatably mounted around the drive shaft 41 is a sensor mechanism 92. This comprises a bridge 93 having a pair of arms 94 and 95 which extend radially out from the drive shaft 41 and are rotatably journalled by it, the arm 94 being journalled on the shaft of the crank 44. Integrally formed with the bridge 93 are three curved fingers 96, 97 and 98. The lengths of these fingers differ such that the right-hand most finger 96 as seen from the rear is longer than the middle finger 97 and the middle finger 97 is in turn longer than the left-hand most finger 98 for reasons which will be explained. These fingers are capable of engaging in with the teeth 81 and 82 on the chance wheels.

The fingers 96, 97 and 98 engage with the teeth 81 and 82 of the wheels 18 to 22 in an arcuate path offset from a path that would intersect the axis of rotation of the wheels 18 to 22 i.e. the shaft 80. In this way, a longer arcuate path of travel of the fingers 96, 97 and 98 is provided after the initial contact with teeth 81 and 82. This longer path of travel provides for easier and more accurate control of the interval between stopping of adjacent wheels 18 to 22 and a longer travel of the sensor mechanism from the advanced position to the payout position.

Mounted around the drive shaft is a coil spring 100. One end of this spring engages a projection 101 on the bridge 93 whilst the other end engages a stop 102 in the front of the chassis 40. In this way, the sensor 92 is resiliently urged in a sense that the fingers 96 to 98 are urged towards the teeth 81 and 82.

When the fingers 96 to 98 engage the teeth 81 and 82 on the chance wheels, two things occur. Firstly, when the fingers abut the teeth, they stop any rotation of their respective wheels. The fingers, after penetrating between a respective pair of teeth 81 and 82 and so stopping the wheels, will then either be able to carry on past the teeth or will abut the bent portion of a tooth 82 which stops further advance. This will depend upon the particular orientation of a chance wheel at which it stops when the finger first penterates between a pair of teeth 81 and 82.

As explained above, the teeth are of two types. Some teeth, in this example alternative teeth, are simple straight teeth 81 whilst the other teeth 82 are of a bent shape and have a turned in portion 103. In the event that a finger 96 to 98 abuts between a pair of teeth 81 and 82 such that it engages a bent portion 103, then that portion will prevent further forward advance movement of the sensor 92. However, if it abuts between a pair of teeth 81 and 82 such that there is no bent portion 103 for it to abut, then the sensor is capable of advancing further to the position shown in broken lines in FIG. 6. Of course, whether the sensor will advance further in a particular case will depend upon whether all three fingers have the same relative orientation if relation to their respective chance wheels or, in other words, a winning or jackpot position.

Some markings or indicia on the wheels, in this example alternate markings, are winning indicia but to obtain a jackpot position, three winning indicia need to be aligned. There is therefore in this example a one-in-eight chance of a jackpot and the relative orientations of the two sorts of teeth 81 and 82 with the visible markings on the cylinder are such that a jackpot position is only possible when, for example, a winning indicia like the word "BAR" (see FIG. 1) appears in the window in the front of the toy for all chance wheels.

The right-hand most wheel 18 as seen from the rear is stopped first, the middle wheel 20 be stopped second and the left-hand most wheel 22 be stopped last. This is achieved, for example, by three differing lengths of the respective fingers 96, 97 and 98. Thus, the finger 96 is the longest and extends radially in towards the wheel 18 more than the finger 97 and in turn that finger 97 extends radially further into the wheel 20 than the finger 98 in towards the wheel 22. Thus, as the sensor 92 rotates under the effect of the spring 100, first of all, the wheel 18 will be stopped by the engagement of the finger 96 with the teeth 81 and 82 on the side of that wheel 18, then the wheel 20 is stopped by the finger 97 and finally the wheel 22 is stopped by the finger 98. Other orders of wheel stopping can be achieved by switching fingers 96, 97 and 98 to stop the wheels in any sequence desired. All the wheels could be stopper at the same time by making all of the fingers the same length.

An alternate method of achieving sequential stopping of the wheels 18 to 22 is to have each of the fingers 96, 97 and 98 of the same length while varying the radial position of the teeth 81 and 82 as between different wheels 18 to 22. The first wheel 18, to be stopped first, will have teeth 81 and 82 at a greater radial distance from the axis of the wheel than the teeth 81 and 82 on wheels 20 and 22 and the teeth 81 and 82 on wheel 20, to be stopped second, will in turn be at a greater radial distance from the axis of the wheel than the teeth on the wheel 22, which is to be stopped after wheel 20. By switching wheel positions other stop sequences can be achieved.

The sensor mechanism 92 is withdrawn or cocked by the action of hinging of the handle 16 because it is linked by means of a cord 104 with the arm 71 on the crank 57. The length of cord 104 extends down from the cross member 93 of the sensor through a hole 105 in the wall 38 of the chassis, passes for a short distance underneath the chassis and then back up through another hole 106 and it is then joined onto the arm. The cord is initially slack so that there is a certain amount of lost motion, the sensor 92 initially remaining in place to hold the wheels 18 to 22 sationary whilst the crank 57 begins its rotation.

Thus, when the handle is drawn forward (see FIG. 1), the arm 71 is pivoted upwardly about the drive shaft 41 and the cord 104 becomes taught and slides through the holes 105 and 106 so pulling the sensor mechanism 92 downwardly against the resilient action of the spring 100. This withdraws the fingers 96 to 98 from between the teeth 81 and 82 and so allows the chance wheels 18 to 22 to be rotated by the kick imparted by the gear train 74 as has been described above once the pawl 54 releases. The sensor mechanism 92 is then allowed to return so that the fingers 96 to 98 can penetrate between the respective drive wheels 18 to 22 and stop them and also sense for a winning position or a jackpot position under the effect of the spring 100. As will be appreciated, this sensor mechanism undertakes two functions in that it will both stop the chance wheels and detect a winning position whereas in many previous arrangements, one mechanism for stopping the wheels and a separate mechanism sensing a winning position has been necessary. The present arrangement greatly simplifies the number of parts therefore.

So that the sensor mechanism 92 does not return instantly and stop the wheels too quickly, the damper mechanism 67 is provided.

Figure 7:
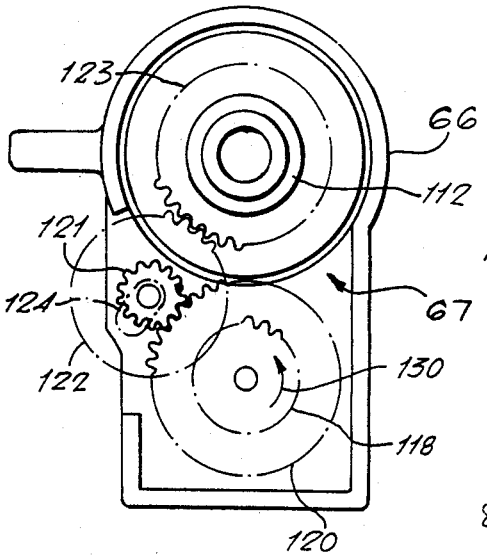
FIG. 7 is a detail section taken on the line 7—7 of FIG. 3.
Figure 8:
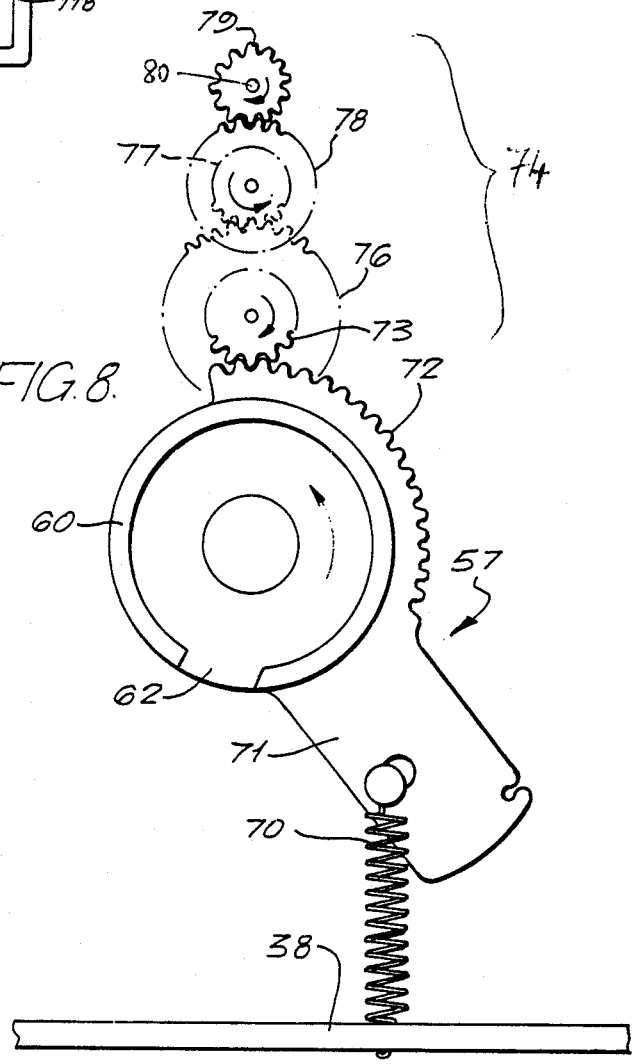
FIG. 8 is a detail section taken on the line 8—8 of FIG. 3.
Figure 9:
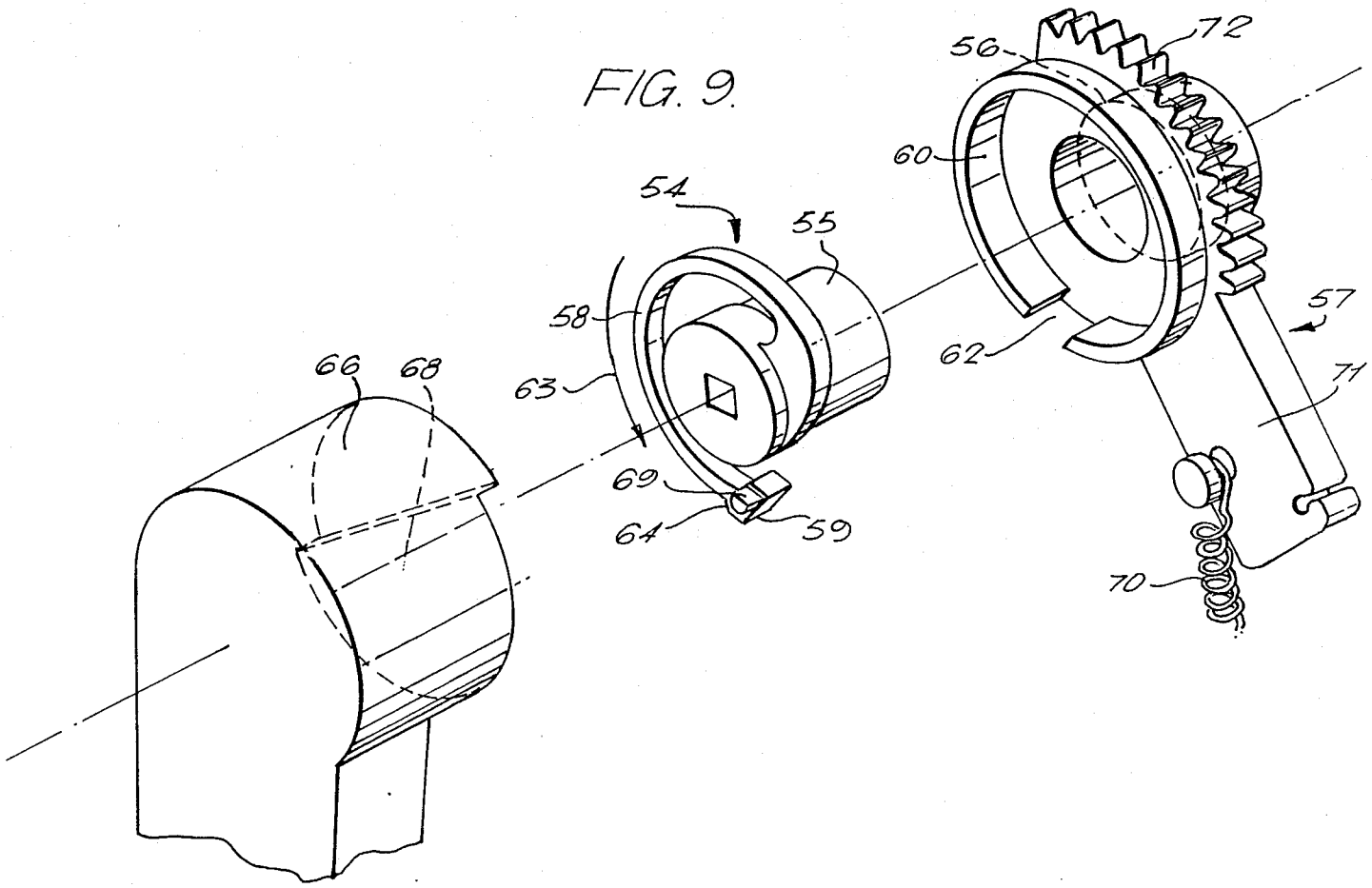
FIG. 9 is an exploded detail of the clutch mechanism for driving the chance wheels.
Figure 10:
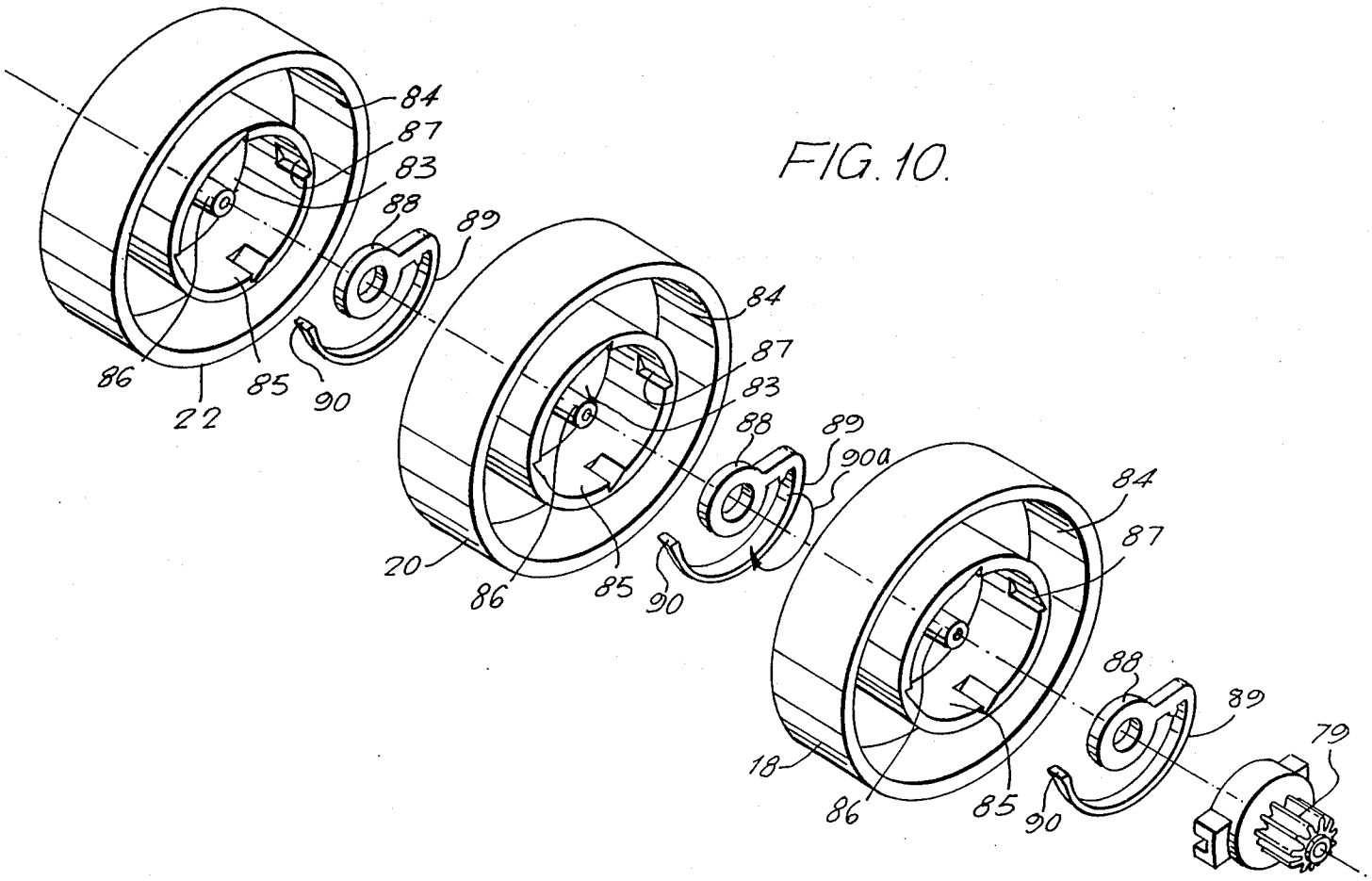
FIG. 10 is an exploded detail of the chance wheels and the arrangement for driving them.

This is best shown in FIG. 7 and comprises a friction wheel 112 mounted freely about the shaft 41. This friction wheel is mounted within the stationary casing 66. So that the wheel 112 is impeded in its rotation relative the casing, it is covered with a material like silicon grease which provides resistance to movement but does not prevent movement.

On the arm 95 of the sensor mechanism 92 is provided a sector-shaped gear wheel 116 which engages with a pinion 118 during a portion of the arcuate movement of the sensor mechanism 92. This pinion 118 is rotatably mounted in the casing 66 and forms an initial part of a step-up gear train which drives the friction wheel 112 as the sector mechanism rotates. This step-up gear train includes a gear 120 integral with the pinion 118 which in turn drives the pinion 121 that is integral with gear 122 which drives a pinion 123 integrally formed with the friction wheel 112.

The pinion 121 and gear 122 are however rotatably mounted in a curved slot 124. As the sensor mechanism 92 is retracted, so rotating the pinion 118 in the sense of the arrow 130 (see FIGS. 6 and 7), this drives the pinion 121 and gear 122 to the lower end of the slot 124 so that the gear 122 no longer engages the pinion 123. The pinion 121 and gear 122 freely rotate without imparting any rotation to the friction wheel 112 therefore.

However, as the sensor mechanism 92 returns to its advanced position for stopping the wheels and detecting a jackpot position, the pinion 121 and gear 122 will now be driven to the other end of the slot 124 in the sense seen in FIG. 7 and so the gear 122 will engage the pinion 123 and this movement of the sensor will drive the friction wheel 112.

Because of the high mechanical advantage of the gear train and the damping and friction to movement applied by the grease to the friction wheel 112, the wheel 112 will only be moved relatively slowly under the effect of the spring 100 and so the sensor mechanism 92 will only slowly return. In this way, this gives the chance wheels 18 to 22 the opportunity to rotate for a significant number of rotations before they become stopped.

The sector shaped gear wheel 116 is provided with only enough gear teeth to engage the pinion 118, and thus the damper mechanism 67, during the rotation of the sensor mechanism 92 from its retracted position substantially to its advanced position when all of the wheels 18 to 22 have been stopped from rotation by reason of contact with fingers 96, 97 and 98 of the sensor mechanism 92. Substantially at that angle of rotation of the sensor mechanism 92, the sector gear 116 disengages from the pinion 118 by reason of a lack of further gear teeth on the sector gear 116 thereby permitting further rotation of the sensor mechanism 92 unimpeded by damper mechanism 67 This unimpeded rotation of the sensor mechanism 92 from the advanced position to the payout position permits the sensor mechanism 92 to rapidly activate the jackpot releasing mechanism, as described below, as soon as a winning combination is displayed on the chance wheels 18 to 22.

Figure 6:
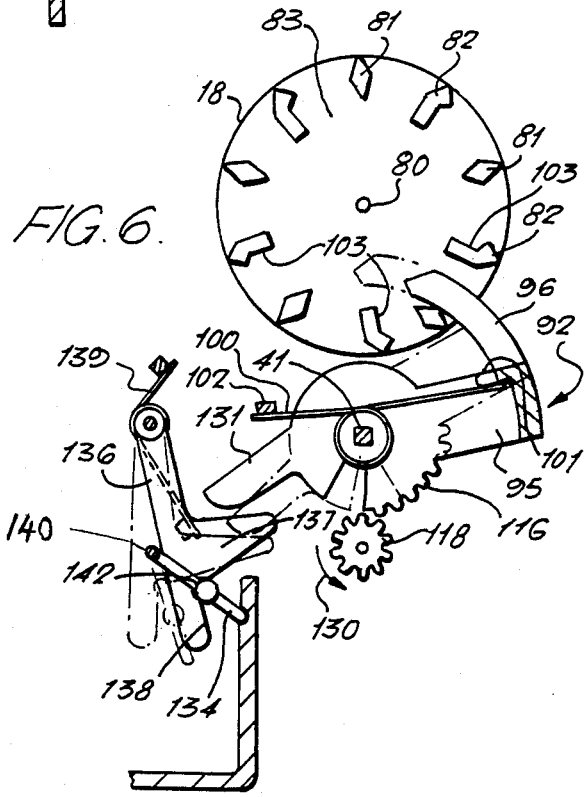
FIG. 6 is a detail section taken on the line 6—6 of FIG. 3.

As best shown in FIG. 6, the sensor additionally comprises an integral crank arm 131. This extends out forwardly of the front of the chassis 40 and this arm controls the opening of a hinged flap 134. This flap forms the base of the coin store 27 to which coins have access through the slot 26 as has been described in connection with FIG. 1. Under normal circumstances this flap is shut, i.e. hinged to the upward position shown in FIG. 2.

A lever 136 is pivotedly mounted on the front of the chassis 40 and hangs downwardly. It has an integral inwardly projecting arm 137 capable of being engaged by the arm 131. At its lower end, it has a cam shaped surface 138 which controls the opening and closing of the flap 134. It is resiliently held by means of a coil spring 139 so that it is urged in a rearward sense as viewed from the front.

The flap 134 has a pair of spigots 140 at either side about which it is hinged. These spigots are engaged in recesses 141 in front of the chassis and extending outwardly from the side of the door is an integral pin 142. This pin engages with the cam surface 138 on the lower end of the arm 136. As a result of the resilient pressure from the spring 139, the arm is urged rearwardly and cam surface 138 engages with the pin 142 and pushes the flap 134 in an upward sense so closing the lower end of the coin store 27. The arrangement of the cam surface 138 is such that it has a cut-in portion in which the pin 142 rests to hold the flap closed. An arrangement such as this is described in corresponding application Ser. No. 734,709 filed 16th May 1985 to which reference is made for a full description of its operation. Under normal circumstances, the flap 134 will remain shut until a jackpot position is sensed.

When a jackpot position is sensed, the sensor 92 can, as explained above, rotate about the drive shaft 41 somewhat further than would be normal if one of the fingers 96 to 98 engages a bent position 103 on a tooth 82.

This further advance position of the sensor 92 is shown in dotted line in FIG. 6. As the sensor is able to rotate further around the drive shaft under the effect of the spring 100, the arm 131 will engage the rearwardly projecting arm 137 on the lever 136 and cause the lever to pivot outwardly against the action of the spring 139. This outward movement in turn will release the flap 134 and allow the release of any coins in the money store 27. As a result, such coins will fall out through the now open bottom of the store into the chamber 28 at the front and will be presented to the player as a jackpot.

When the handle 16 is again operated, then the sensor 92 is withdrawn by means of the cord 104 in the usual way and as soon as the arm 131 no longer engages with the rearward arm 137 on the lever 136, the spring 139 will urge the lever 136 back to its normal position and in turn the cam surface 138 engages the pin 142 on the side of the flap and causes the flap to hinge upwardly and close.

The operation of the mechanism is believed to be entirely clear. As will be appreciated, the device is relatively simple and contains a significant reduction in the number of parts which are necessary as compared with prior art of slot machine devices. Also, anyone who has the toy money box has the added fun of being able to insert coins either for long term storage through the slot 30 or through the slot 26 to see if by chance they will be returned.

Although the damper mechanism 67 is shown as including a friction wheel to delay the operation of the sensor mechanism 92, other types of damper mechanism are eawually possible. For example, the damper mechanism could include an air vane, an air pot, an escapement mechanism, an inertia wheel where the mass of a rotating wheel impedes its rotations and so slows the operation, an eccentric wheel where the unbalance of the wheel impedes its rotations and so slows the operation or other known type of damper mechanism.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

We claim:

1. A machine comprising an outer casing, a first coin inlet formed in said casing, a money store within said casing into which coins pass when inserted into said first coin inlet, a base to said money store movable to a normally closed position to retain coins in said store and an open jackpot position to release coins from said store, a number of rotatable chance wheels mounted in said casing and arranged to be spun and stopped at random orientations, indicia carried by said wheels, only certian of said indicia being winning indicia when a respective wheel stops with one of certain indicia in a winning orientation whereby when said wheels stop in a winning orientation the resulting array of indicia corresponds to movement of said base to said jackpot position, sensor means pivotably mounted in said casing for engaging said wheels to detect winning orientation of winning indicia and being capable of moving said base to said jackpot position when said winning orientation is detected, and drive means for rotating said chance wheels, said drive means including a manually operated handle hingedly mounted to and exterior of said casing, gear means driven by said handle and engaging a first one-way clutch mechanism for rotating a first chance wheel, a second one-way clutch mechanism between said first and second chance wheel for rotating said second chance wheel when said first chance wheel is rotated by said first one-way clutch mechanism, and additional one-way clutch mechanisms between subsequent adjacent pairs of chance wheels for driving subsequent chance wheels sequentially after each preceding chance wheel is driven into rotation, said subsequent wheels and the one-way clutches between said wheels being freely rotatable about a common supporting shaft.

2. A machine according to claim 1 and further comprising a clutch mechanism to disengage the drive between the handle and the gear train, and resilient means to which energy is imparted as the handle is hinged forward to drive said chance wheels into rotation.

3. A machine comprising an outer casing, a plurality of rotatable chance wheels mounted in said casing and arranged to be spun and stopped at random orientations, indicia carried by said wheels, and drive means engaging a first one-way clutch mechanism for rotating a first of said wheels, a second one-way clutch mechanism between the first of said wheels and a second of said wheels for rotating said second wheel by rotation of the first of said wheels, and additional one-way clutch mechanisms between subsequent adjacent pairs of said wheels for rotating subsequent said wheels sequentially by the rotation of each preceding said wheel when said preceding wheel is driven into rotation, said subsequent wheels and the one-way clutches between said wheels being freely rotatable about a common supporting shaft.

4. A machine according to claim 3 in which said drive means include a handle hingedly mounted on and exterior of said casing, resilient means to which energy is imparted and stored as said handle is hinged, a gear train connected to said first one-way clutch mechanism to drive said first one-way clutch mechanism into rotation, said gear train being rotatably driven by the energy stored in said resilient means.

5. A machine comprising an outer casing, a first coin inlet formed in said casing, a money store within said casing into which coins pass when inserted into said first coin inlet, a base to said money store movable to a normally closed position to retain coins in said store and an open jackpot position to release coins from said store a number of rotatable chance wheels mounted in said casing and arranged to be spun and stopped at random orientations, indicia carried by said wheels, only certain of said indicia being winning indicia when a respective wheel stops with one of certain indicia in a winning orientation whereby when said wheels stop in a winning orientation the resulting array of indicia corresponds to movement of said base to said jackpot position, sensor means pivotably mounted in said casing for engaging said wheels to detect winning orientation of winning indicia and being capable of moving said base to said jackpot position when said winning orientation is detected, and drive means for rotating said chance wheels, said drive means including a manually operated handle pivotably mounted to and exterior of said casing and, between said handle and said chance wheels, a clutch mechanism comprising an outer cylindrical housing provided with an opening in the cylindrical wall thereof, enclosed within that cylindrical housing is a driven pawl mechanism including a resilient arm having an end capable of engaging in said opening, the arrangement being such that when said end of said arm is engaged in said opening, rotation of said pawl in one direction by said handle causes said end to engage said opening and drive said outer housing, said end further comprising a projecting portion engageable by cam means on a non-rotatable member relative said pawl member, said cam means on said non-rotatable member caming said end out of engagement with said opening at one limit position whereby once said end is camed out of engagement with said opening, the outer housing and pawl are free to rotate relative one another.

6. A machine according to claim 5 in which said pawl is directly connected to said hinged handle and so driven by it whilst said outer housing has gear teeth engaging a gear drive train to drive said chance wheels.

7. A machine according to claim 5 in which said outer housing has gear teeth engaging a gear drive train including a first one-way clutch to drive the first of said wheels.

8. A machine comprising an outer casing, a first coin inlet formed in said casing, a money store within said casing into which coins pass when inserted into said first coin inlet, a base to said money store movable to a normally closed position to retain coins in said store and an open jackpot position to release coins from said store, a number of rotatable chance wheels mounted in said casing and arranged to be spun and stopped at random orientations, indicia carried by said wheels, only certain of said indicia being winning indicia when respective wheel stops with one of certain indicia in a winning orientation whereby when said wheels stop in a winning orientation the resulting array of indicia corresponds to movement of said base to said jackpot position, drive means including a manually operated handle pivotably mounted on and exterior of said casing for rotating said chance wheels, and a one-piece sensor means pivotably mounted in said casing for engaging said wheels to sequentially stop them and to detect winning orientation of winning indicia, said one-piece sensor means comprising a sensor member pivotably mounted in the casing and resiliently urged from a retracted position to an advanced position, the member being releasably connected to the handle so as to be moved to its retracted position as the handle is operated and the member comprising integral fingers, one associated with each chance wheel, and said chance wheels further comprising stop means to be contacted by said fingers, whereby when said fingers initially engaged said stop means the respective chance wheel is stopped, and said stop means further being of two types, one corresponding to a winning orientation on a chance wheel and the other corresponding to a non-winning orientation which has a stop to prevent said sensor advancing beyond its advanced position, whereby the arrangement of the fingers and the stop means is such that when all fingers engage with a stop means of a winning type, such fingers and so said sensor member is able to advance further beyond said advanced position, and said sensor member further comprising an integral arm for moving said base to said money store to said jackpot position when said sensor member is able to advance beyond its said advanced position.

9. A machine according to claim 8 wherein said fingers travel in an arcuate path that is offset from a path that would intersect the axis of rotation of the corresponding wheel.

10. A machine according to claim 8 further comprising timer means engaged by said sensor means for controlling the rotational speed of said sensor means during a portion of its movement with said sensor means disengaging from said timer means for the remaining portion of said sensor means movement.

11. A machine comprising an outer casing, a plurality of rotatable chance wheels mounted in said casing and arranged to be spun and stopped at random orientations, indicia carried by said wheels, stopping elements formed on said wheels, some of said stopping elements having different constructions and certain of said indicia corrosponding to a difference in construction of a stopping element on said wheels, drive means for rotating said chance wheels, a one-piece sensor means pivotably mounted in said casing and resiliently urged from a retracted position to an advanced position, said sensor means being releasably connected to the drive means so as to be moved to its retracted position as the drive means is operated, said sensor means comprising a plurality of arcuately shaped integral fingers, each of said fingers fixedly attached to said sensor means, each of said fingers corresponding to one of said wheels, said fingers engaging said wheels to sequentially stop said wheels and to sense said difference in construction of said stopping elements corresponding to the orientation of said indicia on the stopped said wheels, whereby the arrangement of the fingers and the stop means is such that when all fingers engage with a stop means of a certain type, said fingers and said sensor means are able to advance further beyond said advanced position.

12. A machine according to claim 11 wherein said fingers travel in an arcuate path that is offset from a path that would intersect the axis of rotation of its corresponding said wheel.

13. A machine according to claim 11 wherein said sensor means engages a timer means for controlling the rotational speed of said sensor means during a portion of its arcuate movement with said sensor means disengaging from said timer means for the remaining portion of said sensor means arcute movement.

14. A machine comprising:

an outer casing;

a plurality of indicia carrying rotatable chance wheels, mounted in said casing, adapted to be rotated and stopped at random orientations;

a handle hingedly mounted on and exterior to said casing and capable of being hinged between a rest position and a first position;

resilient means for receiving and storing energy as said handle is hinged;

a drive clutch mechanism including:

a pawl, rotatably driven by said handle, including a resilient arm having an outer end with a projecting portion, said outer end adapted to releasably engage an opening and said projecting portion adapted to cam against a cam surface on a housing member, an outer cylindrical housing, including a cylindrical wall defining an opening in said wall for engaging said outer end, for releasably enclosing said pawl, a housing member, non-rotatable relative said pawl, including a cam surface adapted to cam against said projecting portion of said pawl, whereby when said handle is hinged to said first position, camming action of said projecting portion together with said cam surface causes said outer end of said pawl to release from said opening, allowing said outer housing and said pawl to rotate relative one another in response to the energy stored in said resilient means;

a gear train, rotatably driven by the energy stored in said resilient means, connected to a first one-way clutch mechanism for rotating a one-way clutch mechanism;

a first one-way clutch mechanism for rotating the first said chance wheel in response to rotation from said gear train;

a second one-way clutch mechanism, situated between the first and second said chance wheels, for rotating the second chance wheel by rotation of said first chance wheel;

at least one additional one-way clutch mechanism, situated between adjacent chance wheels, for rotating sequentially an adjacent chance wheel upon rotation of the preceding chance wheel.

15. A machine comprising:

an outer casing;

a plurality of indicia carrying rotatable chance wheels, mounted in said casing, adapted to be rotated and stopped at random orientations;

a handle hingedly mounted on and exterior to said casing and capable of being hinged between a rest position and a first position;

resilient means for receiving and storing energy as said handle is hinged;

a drive clutch mechanism including:

a pawl, rotatably driven by said handle, including a resilient arm having an outer end with a projecting portion, said outer end adapted to releasably engage an opening and said projecting portion adapted to cam against a cam surface on a housing member, an outer cylindrical housing, including a cylindrical wall defining an opening in said wall for engaging said outer end and for releasably enclosing said pawl, said housing further including gear teeth for engaging a gear drive train, a housing member, non-rotatable relative said pawl, including a cam surface adapted to cam against said projecting portion of said pawl, whereby when said handle is hinged to said first position, camming action of said projecting portion together with said cam surface causes said outer end of said pawl to release from said opening, allowing said outer housing and said pawl to rotate relative one another in response to the energy stored in said resilient means;

a gear train engaging said gear teeth on said outer cylindrical housing and rotatably driven by the energy stored in said resilient means when said outer end of said pawl releases from said opening, said gear train connected to a first one-way clutch mechanism for rotating a one-way clutch mechanism;

a first one-way clutch mechanism for rotating the first said chance wheel in response to rotation from said gear train;

a second one-way clutch mechanism, situated between said first and second said chance wheels, for rotating said second chance wheel by rotation of said first chance wheel;

at least one additional one-way clutch mechanism, situated between adjacent chance wheels, for rotating sequentially an adjacent chance wheel upon rotation of the preceding chance wheel.

* * * * *